US011059283B2

(12) United States Patent
Kim et al.

(10) Patent No.: US 11,059,283 B2
(45) Date of Patent: Jul. 13, 2021

(54) SCREEN PRINTING DEVICE

(71) Applicant: SUNG AN MACHINERY CO., LTD., Hwaseong-si (KR)

(72) Inventors: Yong Sung Kim, Anseong-si (KR); Jin Woo Seong, Ansan-si (KR)

(73) Assignee: SUNG AN MACHINERY CO., LTD, Hwaseong-si (KR)

( * ) Notice: Subject to any disclaimer, the term of this patent is extended or adjusted under 35 U.S.C. 154(b) by 384 days.

(21) Appl. No.: 16/095,138

(22) PCT Filed: Mar. 20, 2018

(86) PCT No.: PCT/KR2018/003206
§ 371 (c)(1),
(2) Date: Oct. 19, 2018

(87) PCT Pub. No.: WO2018/221845
PCT Pub. Date: Dec. 6, 2018

(65) Prior Publication Data

US 2020/0406603 A1 Dec. 31, 2020

(30) Foreign Application Priority Data

May 30, 2017 (KR) ..... 10-2017-0066596

(51) Int. Cl.
*B41F 15/08* (2006.01)
*B41F 15/40* (2006.01)
*B41F 15/36* (2006.01)

(52) U.S. Cl.
CPC ..... *B41F 15/0813* (2013.01); *B41F 15/36* (2013.01); *B41F 15/40* (2013.01); *B41F 15/405* (2013.01)

(58) Field of Classification Search
CPC ..... B41F 15/08; B41F 15/40; B41F 15/0813; B41F 15/36; B41F 15/405; B05C 9/025
(Continued)

(56) References Cited

U.S. PATENT DOCUMENTS 5,133,120 A * 7/1992 Kawakami ..... H05K 3/4053 174/263
5,540,779 A * 7/1996 Andris ..... B05C 5/0295 118/323

(Continued)

FOREIGN PATENT DOCUMENTS

JP 06-015801 A 1/1994
JP 3755906 B2 3/2006

(Continued)

*Primary Examiner* — Leslie J Evanisko
(74) *Attorney, Agent, or Firm* — Novick, Kim & Lee, PLLC; Sang Ho Lee

(57) ABSTRACT

Provided is a screen printing device. A screen printing device according to an embodiment of the present invention includes: a screen disposed adjacent to an upper portion of a substrate on which a printing process is performed, and having a pattern to be printed on the substrate; a printing unit disposed on an upper portion of the screen and configured to discharge ink supplied from the outside to the screen and to print the pattern on the substrate; a driver connected to at least one of the screen and the printing unit and configured to drive at least one of the screen and the printing unit; and a controller connected to the printing unit and the driver and configured to control operations of the printing unit and the driver, wherein, when at least one of the screen and the printing device moves in a state in which the printing unit contacts the screen, the controller controls the printing device to perform printing on the substrate by using discharge pressure of the ink.

3 Claims, 9 Drawing Sheets

(58) Field of Classification Search
USPC ..... 101/123
See application file for complete search history.

(56) References Cited

U.S. PATENT DOCUMENTS

| | | | | |
|---|---|---|---|---|
| 6,571,701 | B1 * | 6/2003 | Pham-Van-Diep | B41F 31/03 101/129 |
| 2004/0244612 | A1 * | 12/2004 | Willshere | B41F 15/42 101/123 |
| 2013/0047877 | A1 * | 2/2013 | Yoo | B41F 15/42 101/364 |
| 2016/0159073 | A1 * | 6/2016 | Liu | B41F 15/40 101/123 |

FOREIGN PATENT DOCUMENTS

| | | | |
|---|---|---|---|
| JP | 2007-160643 | A | 6/2007 |
| KR | 10-2010-0054411 | A | 5/2010 |
| KR | 10-1664992 | B1 | 10/2016 |

* cited by examiner

SCREEN PRINTING DEVICE

TECHNICAL FIELD

The present invention relates to a screen printing device, and more particularly, to a screen printing device capable of efficiently performing a printing process on a substrate through a simpler structure and operation.

BACKGROUND ART

Generally, a screen printing process means a process of printing ink on a flexible film or foil or a non-flexible plane printing substrate (hereinafter, collectively referred to as a substrate in the present invention) by using a screen on which a pattern is formed.

A general screen printing device used in the screen printing process includes a screen on which a pattern for performing a printing process on a substrate is formed, a scraper configured to apply ink on the screen, and a squeegee configured to perform a printing process on the substrate by pressurizing the screen applied with the ink to allow the ink to pass through the screen and transferring the ink onto the substrate, and a plurality of drivers configured to drive the screen, the scraper, and the squeegee.

Such a screen printing device performs two cycles of applying ink and printing the ink. The two cycles may be classified into a method in which a scraper and a squeegee perform applying and printing processes while alternately moving vertically on a plane on which a screen moves and a method in which a scraper and a squeegee perform applying and printing processes while alternately moving vertically and horizontally on an upper portion of a fixed screen.

FIG. 1 is a view illustrating a structure and operation of a general screen printing device.

FIG. 1 illustrates a state in which a flat screen printing device 10 of various types of screen printing devices performs a printing process.

As illustrated in FIG. 1, the flat screen printing device 10 may include a backup roller 11, a screen 12, a scraper 13, and a squeegee 14.

The backup roller 11 may transport a substrate S while supporting one surface of the substrate S such as a film, a web, or the like. In addition, the screen 12 is spaced apart from the backup roller 11, and a pattern (not shown) for performing a printing process on the substrate S may be formed thereon.

The scraper 13 may be movably disposed in a state of being in contact with or spaced apart from the screen 12 and may apply ink on the screen 12. Furthermore, the squeegee 14 is disposed adjacent to the scraper 13 so as to be movable in a state of being in contact with or spaced apart from the screen 12 and may transfer the ink applied on the screen 12 onto the substrate S to perform a printing process.

(a) of FIG. 1 illustrates a state in which the scraper 13 moves in a first direction (left direction of FIG. 1) and applies ink on the screen 12. (b) of FIG. 1 illustrates a state in which the squeegee 14 moves in a second direction (right direction of FIG. 2) while pressurizing the screen 12, and performs a printing process on the substrate S.

However, since the conventional screen printing device 10 includes the scraper 13 configured to applying ink on the screen 12, the squeegee 14 configured to print ink on the substrate S while pressurizing the screen 12, and a driver (not shown) connected to the scraper 13 and the squeegee 14, an entire mechanism structure is somewhat complicated.

Since simple sequence control according to repetitive operations is performed, it is difficult to perform precise control, and it is difficult to cope with a delicate change in a process condition.

In addition, as illustrated in (b) of FIG. 1, the squeegee 14 should pressurize the screen 12 by a snap-off between the screen 12 and the substrate S in a process of printing ink. Thus, since the screen 12 is repeatedly pressurized during a printing process, plastic deformation is generated in the screen 12, resulting in non-uniformity of printing quality and a reduction in durability of the screen 12.

Furthermore, since the conventional screen printing device 10 performs a printing process in a state in which a large amount of ink is supplied on the screen 12 in advance in order to maintain a physical property such as viscosity of ink (or paste), unnecessary waste of ink is serious, and printing quality is degraded due to a change in a physical property (for example, a change in viscosity) of the ink exposed in the air.

Therefore, there is a need for a screen printing device capable of efficiently performing a printing process on a substrate through a simpler structure and operation.

SUMMARY OF INVENTION

Technical Problem

The present invention has been made in an effort to solve the above problems, and an object of the present invention is to provide a screen printing device capable of efficiently performing a printing process on a substrate through a simpler structure and operation by discharging ink in a required amount for printing at preset pressure and transferring the ink discharged to the screen onto the substrate by discharge pressure of the ink to print a pattern.

The technical objects of the present invention are not limited to the above-mentioned object, and other technical objects will be clearly understood from the following description by those skilled in the art.

Solution to Problem

In order to achieve the above objects, a screen printing device includes: a screen disposed adjacent to an upper portion of a substrate on which a printing process is performed, and having a pattern to be printed on the substrate; a printing unit disposed on an upper portion of the screen and configured to discharge ink supplied from the outside to the screen and to print the pattern on the substrate; a driver connected to at least one of the screen and the printing unit and configured to drive at least one of the screen and the printing unit; and a controller connected to the printing unit and the driver and configured to control operations of the printing unit and the driver, wherein, when at least one of the screen and the printing device moves in a state in which the printing unit contacts the screen, the controller controls the printing device to perform printing on the substrate by using discharge pressure of the ink.

The printing unit includes a body having an ink supply hole formed in one side thereof, through which the ink is injected, and having an injection path formed therein, through which the ink moves; an ink pressurizing part disposed at the one side of the body so as to communicate with the injection path and configured to pressurize the ink which moves through the injection path; an ink discharge part disposed at one side of the body, facing the screen, so as to communicate with the injection path and configured to discharge the ink in a state of being in contact with screen; and at least one pressure measurement part installed at a position adjacent to the ink discharge part of the body and configured to measure discharge pressure of the ink discharged from the ink discharge part, wherein the controller controls the ink pressurizing part to adjust an discharge amount and the discharge pressure of the ink according to a measurement result of the at least one pressure measurement part.

The body has at least one cavity formed therein, which communicates with the injection path and accommodates the ink.

The ink discharge part is detachably installed at the one side of the body.

The printing unit further includes a temperature measurement part installed at a position adjacent to the ink discharge part of the body and configured to measure temperature of the ink discharged from the ink discharge part; and a temperature adjustment part disposed between the ink pressurizing part and the ink discharge part and configured to adjust the temperature of the ink, wherein the controller controls the temperature adjustment part to adjust the temperature and viscosity of the ink discharged from the ink discharge part according to a measurement result of the temperature measurement part.

The temperature adjustment part includes at least one heating member disposed adjacent to the injection path between the ink pressurizing part and the ink discharge part; and at least one cooling member disposed outside the at least one heating member between the ink pressurizing part and the ink discharge part.

Specific matters of the embodiments are included in the detailed description and the drawings.

Advantageous Effects of Invention

According to a screen printing device according to embodiments of the present invention, since a printing unit prints a pattern by discharging ink in a required amount for printing at preset pressure and transferring ink discharged to a screen onto a substrate, the screen may not be directly pressurized to minimize deformation of the screen, thereby improving durability of the whole of the screen printing device. In addition, since overall uniform printing is possible by minimizing a snap-off between the screen and the substrate, thereby efficiently performing a printing process on the substrate through a simpler structure and operation.

According to a screen printing device according to embodiments of the present invention, a printing unit may perform a printing process during one movement, thereby simplifying an entire printing process into one process and increasing printing speed.

According to a screen printing device according to embodiments of the present invention, discharge pressure of ink discharged from an ink discharge part may be measured, and the ink accommodated in a body may be pressurized according to a measurement result to control an discharge amount and discharge pressure of the ink. Thus, since unnecessary waste of the ink is reduced, the screen printing device may be easily applied to the expensive ink.

According to a screen printing device according to embodiments of the present invention, discharge pressure of ink discharged from an ink discharge part may be measured, and the ink accommodated in a body may be pressurized according to a measurement result to control an discharge amount and discharge pressure of the ink. Thus, since the ink is directly pressurized, the screen printing device may be applied ink having high viscosity, and since relatively high aspect ratio printing is possible, overall printing quality may be improved, when compared with limited pressure of an existing squeegee.

According to a screen printing device according to embodiments of the present invention, discharge pressure of ink discharged from an ink discharge part may be measured, the ink accommodated in a body may be pressurized according to a measurement result to control an discharge amount and discharge pressure of the ink, and the ink used for printing may be controlled so as to be discharged and used in a required amount in a state of being accommodated in an injection path of the body. Thus, it is possible to reduce unnecessary waste of the ink and to minimize a change in a physical property due to environmental exposure of the ink, thereby improving overall printing quality.

According to a screen printing device according to embodiments of the present invention, since a cavity configured to temporarily accommodate ink is formed in a body constituting a printing unit, the ink discharged from a long ink discharge part may be uniformly discharged in a width direction of a screen.

According to a screen printing device according to embodiments of the present invention, an ink discharge part formed at one side of a body constituting a printing unit may be detachably implemented, thereby reducing maintenance costs and simplifying maintenance operations of the screen printing device.

According to a screen printing device according to embodiments of the present invention, temperature of ink discharged from a printing unit may be measured, and temperature of the ink moving along an injection path may be controlled according to a measurement result to constantly maintain the temperature and viscosity of the ink used for printing, thereby improving overall printing quality.

According to a screen printing device according to embodiments of the present invention, a heating member may be disposed adjacent to an injection path through which ink moves, and a cooling member may be disposed adjacent to a surface of a body, thereby minimizing influence on a screen, a substrate, and the like when temperature adjustment part controls temperature of ink.

The effects of the present invention are not limited to the effects mentioned above, and other effects can be clearly understood from the description of the claims by those skilled in the art.

DESCRIPTION OF EMBODIMENTS

Figure 1A:
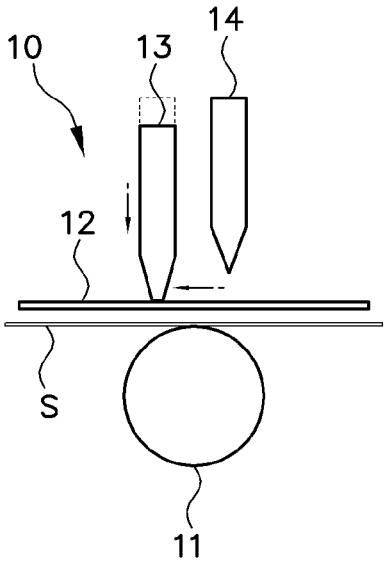
Prior Art FIG. 1A
FIG. 1 is a schematic view illustrating a structure and operation of a general screen printing device.

Hereinafter, preferred embodiments of the present invention will be described in detail with reference to the accompanying drawings so that they can be readily implemented by those skilled in the art.

A description of technical content that is well known to those skilled in the art and is not directly related to the present invention is omitted when embodiments of the present invention are described. The reason for this is to omit unnecessary description, and to more definitely transmit the gist of the present invention rather than making the gist of the present invention unclear.

For the same reason, some components in the drawings are exaggeratedly shown, omitted, or schematically shown. The sizes of respective components in the drawings do not reflect actual sizes. The same or similar reference symbols are used throughout the drawings to refer to the same or like parts.

Hereinafter, the present invention will be described with reference to the drawings illustrating a screen printing device through embodiments of the present invention.

Figure 2:
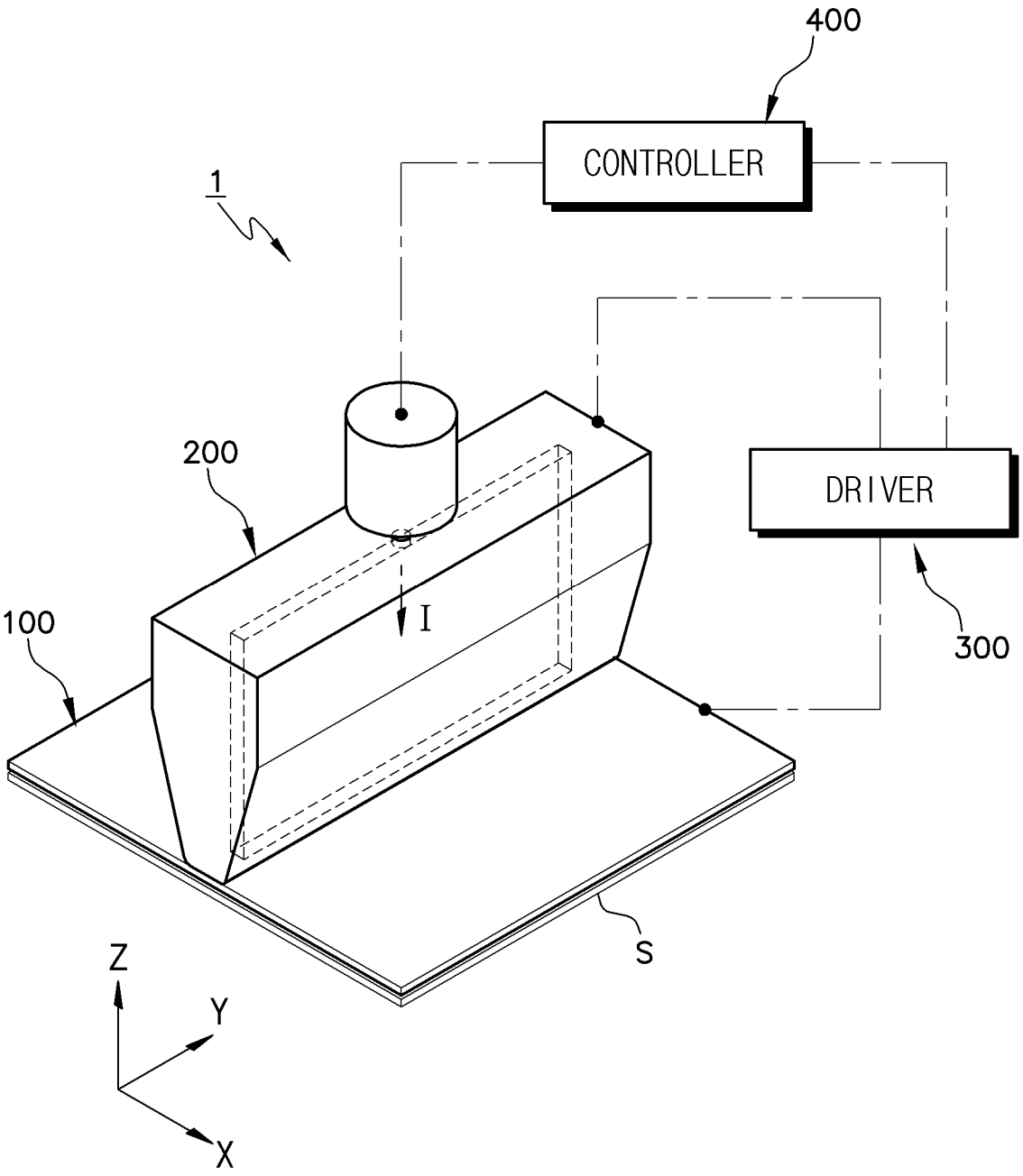
FIG. 2 is a schematic perspective view illustrating a structure of a screen printing device according to an embodiment of the present invention.
Figure 3:
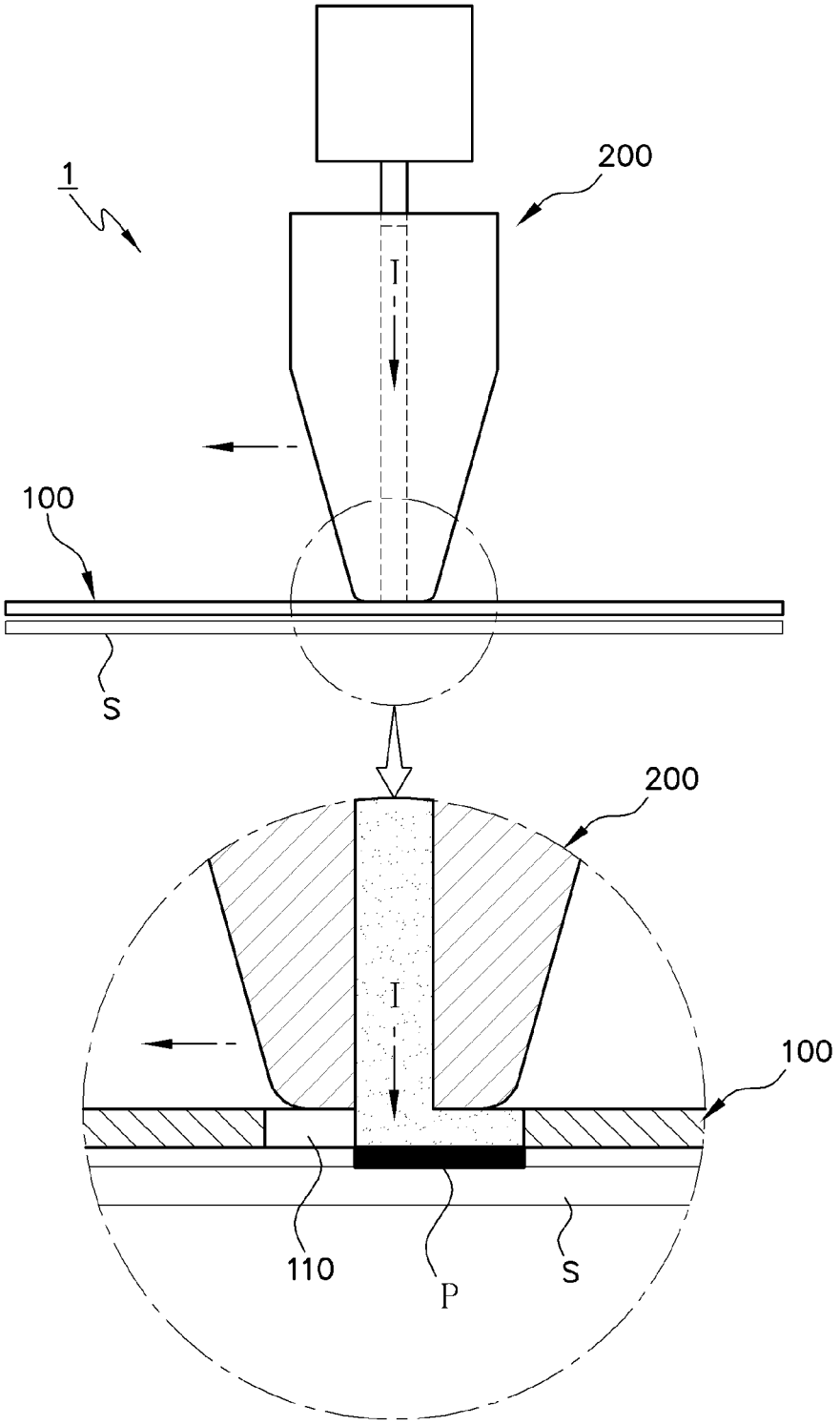
FIG. 3 is a front view illustrating operation of the screen printing device according to the embodiment of the present invention.

FIG. 2 is a schematic perspective view illustrating a structure of a screen printing device according to an embodiment of the present invention. FIG. 3 is a front view illustrating operation of the screen printing device according to the embodiment of the present invention.

As illustrated in FIGS. 2 and 3, a screen printing device 1 according to an embodiment of the present invention may include a screen 100, a printing unit 200, a driver 300, and a controller 400.

The screen 100 may be disposed adjacent to an upper portion of a substrate S on which a printing process is performed, and a pattern to be printed on the substrate S may be formed thereon. In the present invention, of course, the substrate S is a concept including all types of substrates such as a film and a web, on which a printing pattern is formed.

The printing unit 200 may be disposed on an upper portion of the screen 100 and may discharge ink I (or paste, the same shall apply hereinafter) supplied from the outside to the screen 100 to form a pattern (P of FIG. 2) on the substrate S. The printing unit 200 may discharge the ink I to the screen 100 during one movement, and simultaneously, may transfer the ink I discharged to the screen 100 onto the substrate S by using the discharge pressure of the ink I to print the pattern P. A detailed structure of the printing unit 200 will be described later in detail with reference to FIGS. 4 to 9.

The driver 300 may be connected to at least one of the screen 100 and the printing unit 200 to drive at least one of the screen 100 and the printing unit 200. The driver 300 may include various types of actuators such as a cylinder and a driving motor. The driver 300 may be connected to at least one of the screen 100 and the printing unit 200 to move the screen 100 and the printing unit 200 in a vertical direction (±Z direction of FIG. 2), a length direction of the substrate S (±X direction of FIG. 2), or a width direction of the substrate S (±Y direction of FIG. 2) on the upper portion of the substrate S as needed.

The controller 400 may be connected to the printing unit 200 and the driver 300 to control operations of the printing unit 200 and the driver 300. For example, the controller 400 may be connected to the printing unit 200 to control a flow rate, pressure, temperature, and the like of the ink I supplied to the printing unit 200. In addition, the controller 400 may be connected to the driver 300 to control a position, a movement direction, movement speed, and the like of the screen 100 and the printing unit 200.

Preferably, when at least one of the screen 100 and the printing unit 200 moves in a state in which the printing unit 200 contacts the screen 100, the controller 400 of the screen printing device 1 according to the embodiment of the present invention may control the printing unit 200 to perform printing on the substrate S by using the discharge pressure of the ink I.

For convenience of description, FIG. 3 illustrates an example in which the printing unit 200 moves to perform a printing process in a state in which the screen 100 is fixed. As illustrated in FIG. 3, when the printing unit 200 moves in a printing direction (left direction in an example of FIG. 3), the ink I may be discharged to a pattern region 110 of the screen 100 in a required amount for printing at preset pressure, and the ink I discharged to the pattern region 110 of the screen 100 may be transferred onto a surface of the substrate S by using the discharge pressure.

Figure 1B:
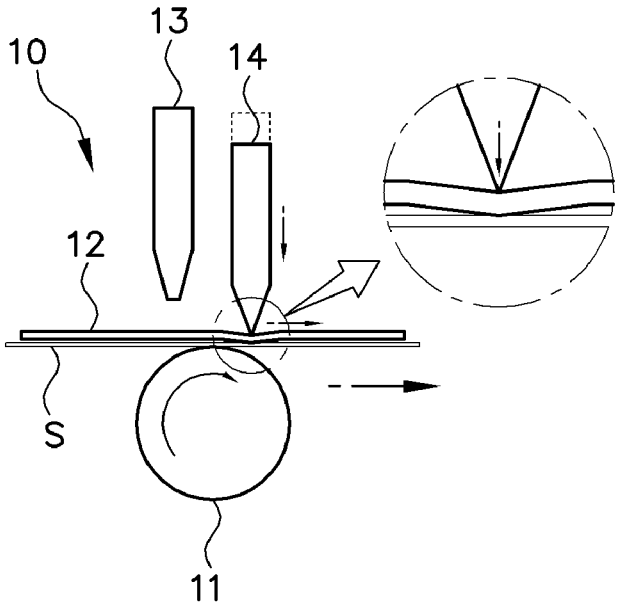
Prior Art FIG. 1B

That is, unlike a squeegee (14 of FIG. 1) which pressurizes a screen (12 of FIG. 1) to transfer ink onto a substrate S in a general printing device (10 of FIG. 1), the printing unit 200 constituting the screen printing device 1 according to the embodiment of the present invention transfers the ink I onto the substrate S by using the discharge pressure of the ink I. Therefore, in the screen printing device 1 according to the embodiment of the present invention, the printing unit 200 may not directly pressurize the screen 100 to minimize deformation of the screen 100, thereby improving durability of the screen 100. In addition, a snap-off between the screen 100 and the substrate S may be minimized, thereby performing overall uniform printing.

Furthermore, the printing unit 200 constituting the screen printing device 1 according to the embodiment of the present invention performs functions of both a scraper (13 of FIG. 1) and the squeegee (14 of FIG. 1) constituting the general screen printing device (10 of FIG. 10) and concurrently performs operations of discharging the ink I and performing printing on the substrate S during one movement rather than reciprocating. Therefore, in the screen printing device 1 according to the embodiment of the present invention, it is possible to further simplify a printing process on the substrate S.

As described above, in the screen printing device 1 according to the embodiment of the present invention, since the printing unit 200 discharges the ink I in a preset required amount for printing at preset pressure, and transfers the ink I discharged to the screen 100 onto the substrate S by using the discharge pressure to print the pattern P, the printing unit 200 may not directly pressurize the screen to minimize deformation of the screen, thereby improving durability of the entirety of the screen printing device 1. In addition, a snap-off between the screen and the substrate may be minimized to perform overall uniform printing, thereby efficiently performing a printing process on the substrate S through a simper structure and operation.

Furthermore, in the screen printing device 1 according to the embodiment of the present invention, the printing unit 200 may perform a printing process during one movement, thereby simplifying the entire printing process into one process and increasing printing speed.

Hereinafter, a structure and operation of the printing unit 200 constituting the screen printing device 1 according to the embodiment of the present invention as configured above will be described in detail with reference to FIGS. 4 to 9.

Figure 4:
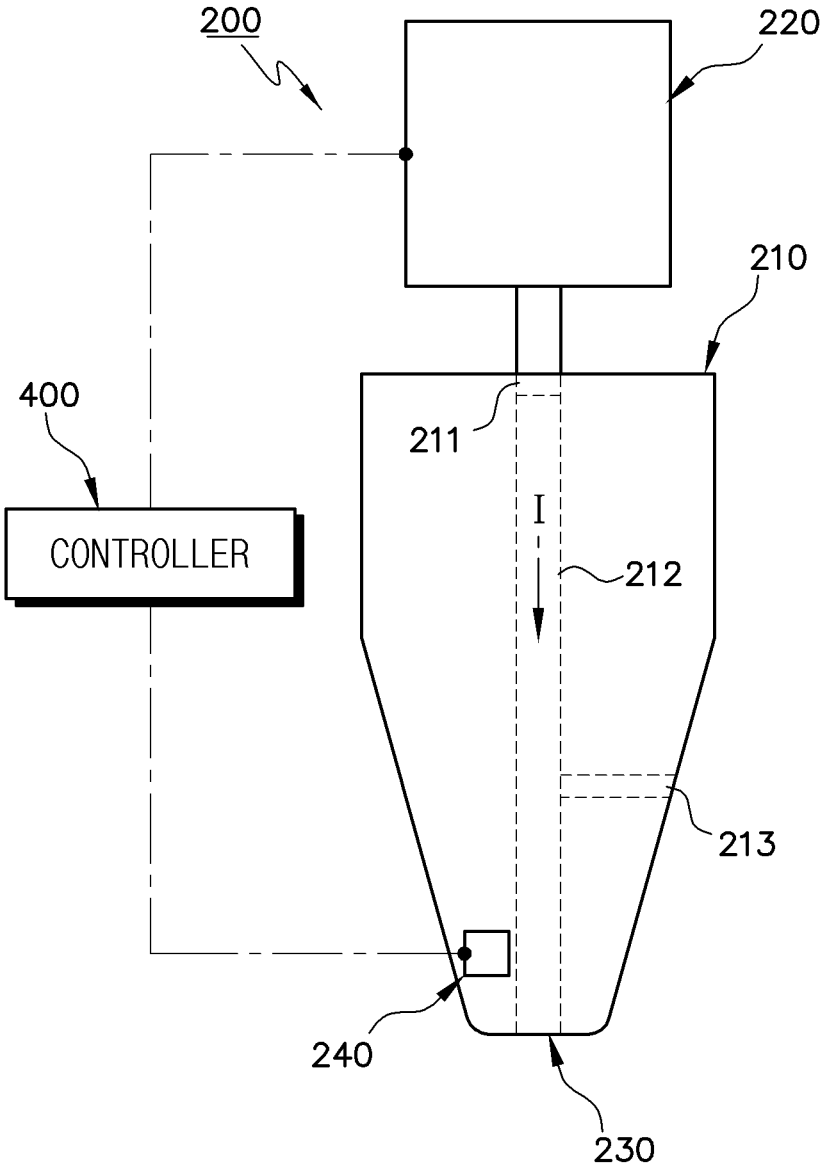
FIG. 4 is a schematic front view illustrating a structure of a printing unit constituting the screen printing device according to the embodiment of the present invention.

FIG. 4 is a schematic front view illustrating a structure of the printing unit constituting the screen printing device according to the embodiment of the present invention.

As illustrated in FIG. 4, the printing unit 200 constituting the screen printing device 1 may include a body 210, an ink pressurizing part 220, an ink discharge part 230, and at least one pressure measurement part 240.

As illustrated in FIGS. 2 and 4, the body 210 is elongated along the width direction (or the length direction) of the substrate S so as to correspond to a width (or a length) of the substrate S, and a lower end thereof may be relatively narrow in a direction toward the screen 100. In addition, the body 210 may have an ink supply hole 211 formed in at one side thereof, through which the ink I is injected from the outside, and have an injection path 212 formed therein, through which the ink I moves.

Here, the injection path 212 means a space through which the ink I moves, as well as a space in which the ink I is accommodated in the body 210. In addition, a through-hole 213 configured to remove bubbles may be connected to the injection path 212, the bubbles being generated during an injection of the ink I.

The ink pressurizing part 220 may be disposed at one side of the body 210 so as to communicate with the injection path 212 and may pressurize the ink I which moves through the injection path 212. The ink pressurizing part 220 may pressurize the ink I at pressure set according to a measurement result of the pressure measurement part 240 and may adjust discharge pressure of the ink I discharged from the ink discharge part 230. The ink pressurizing part 220 may include a pump, a piston, a syringe, or the like. The present invention is not limited thereto, and a method of pressurizing the ink I may be freely changed by a person skilled in the art.

Meanwhile, FIG. 4 illustrates an example in which the ink pressurizing part 220 is directly connected to the ink supply hole 211 through which the ink I is injected. However, the present invention is not limited thereto, and the ink pressurizing part 220 may be connected to any position as long as the position communicates with the injection path 212 through which the ink I moves. A path through which the ink I is injected may be formed differently from a path in which the ink I is pressurized.

Meanwhile, FIG. 4 illustrates an example in which the ink pressurizing part 220 pressurizes the ink I accommodated in the injection path 212 in a state in which an injection of the ink I through the ink supply hole 211 is stopped. However, the present invention is not limited thereto, and the ink pressurizing part 220 may pressurize the ink I even when the ink I is injected though the ink supply hole 211. For example, when the ink pressurizing part 220 is not connected to the ink supply hole 211, the ink pressurizing part 220 may pressurize the ink I accommodated in the injection path 212 even when the ink I is injected though the ink supply hole 211.

An ink discharge part 230 is disposed at one side of the body 210, facing the screen 100, so as to communicate with the injection path 212. The ink I may be discharged in a state in which the ink discharge part 230 contacts the screen 100. FIG. 4 illustrates an example in which the ink discharge part 230 is formed to have the same size and shape as the injection path 212 on the same line as the injection path 212. This is merely an example, and the size, shape, and the like of the ink discharge part 230 may be freely changed according to a type of the screen 100, and a type, a property (for example, viscosity), and the like of the ink I by a person skilled in the art. The ink discharge part 230 is preferably made of an elastic material so as to increase hermeticity when the ink discharge part 230 contacts the screen 100. However, the present invention is not limited thereto, and a material of the ink discharge part 230 may be freely changed according to various conditions such as a material of the screen 100 by a person skilled in the art.

The pressure measurement part 240 may be installed at a position adjacent to the ink discharge part 230 of the body 210 and may measure discharge pressure of the ink I discharged from the ink discharge part 230. The pressure measurement part 240 may be installed at a position adjacent to the ink discharge part 230 along the ink discharge part 212 through which the ink I moves, and at least one pressure measurement part 240 may be provided as needed.

The controller 400 may be connected to the pressure measurement part 240 and the ink pressurizing part 220 and may control the ink pressurizing part 220 to adjust an discharge amount and discharge pressure of the ink I according to a measurement result of the pressure measurement part 240. That is, in order to obtain a desired discharge amount and discharge pressure, the controller 400 may control the ink pressurizing part 220 to pressurize the ink I at appropriate pressure according to an discharge pressure measurement result measured by the pressure measurement part 240.

As described above, in the screen printing device 1 according to the embodiment of the present invention, discharge pressure of the ink I discharged from the ink discharge part 230 may be measured, and the ink I accommodated in the body 210 may be pressurized according to the measurement result to control an discharge amount and discharge pressure of the ink I. Thus, since unnecessary waste of the ink I is reduced, the screen printing device 1 may be applied to the expensive ink I.

In addition, in the screen printing device 1 according to the embodiment of the present invention, discharge pressure of the ink I discharged from the ink discharge part 230 may be measured, and the ink I accommodated in the body 210 may be pressurized according to the measurement result to control an discharge amount and discharge pressure of the ink I. Thus, since the ink I is directly pressurized, the screen printing device 1 may be applied to ink having high viscosity, and since relatively high aspect ratio printing is possible, overall printing quality may be improved, when compared with limited pressure of an existing squeegee.

In addition, in the screen printing device 1 according to the embodiment of the present invention, discharge pressure of the ink I discharged from the ink discharge part 230 may be measured, the ink I accommodated in the body 210 may be pressurized according to the measurement result to control an discharge amount and discharge pressure of the ink I, and the ink I used for printing may be controlled so as to be discharged and used in a required amount in a state of being accommodated in the injection path 212 of the body 210. Thus, it is possible to reduce unnecessary waste of the ink I and to minimize a change in a physical property due to environmental exposure of the ink I, thereby improving overall printing quality.

On the other hand, FIG. 4 illustrates an example in which the body 210 constituting the printing unit 200 is integrally formed. However, the present invention is not limited thereto, and a plurality of bodies may be provided as needed.

Figure 5A:
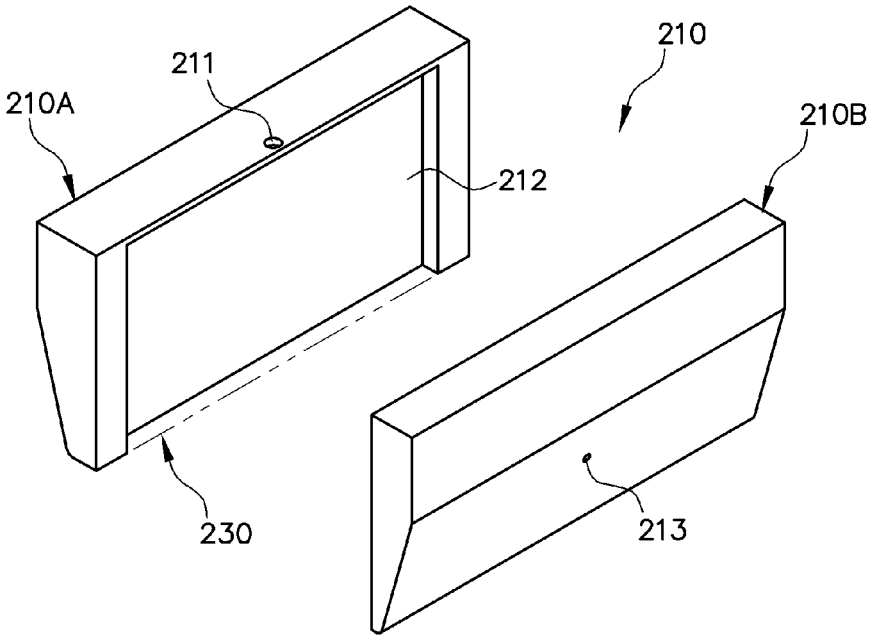
FIG. 5 is a schematic exploded perspective view illustrating a modified example of a body constituting the printing unit of the screen printing device according to the embodiment of the present invention.
Figure 5B:
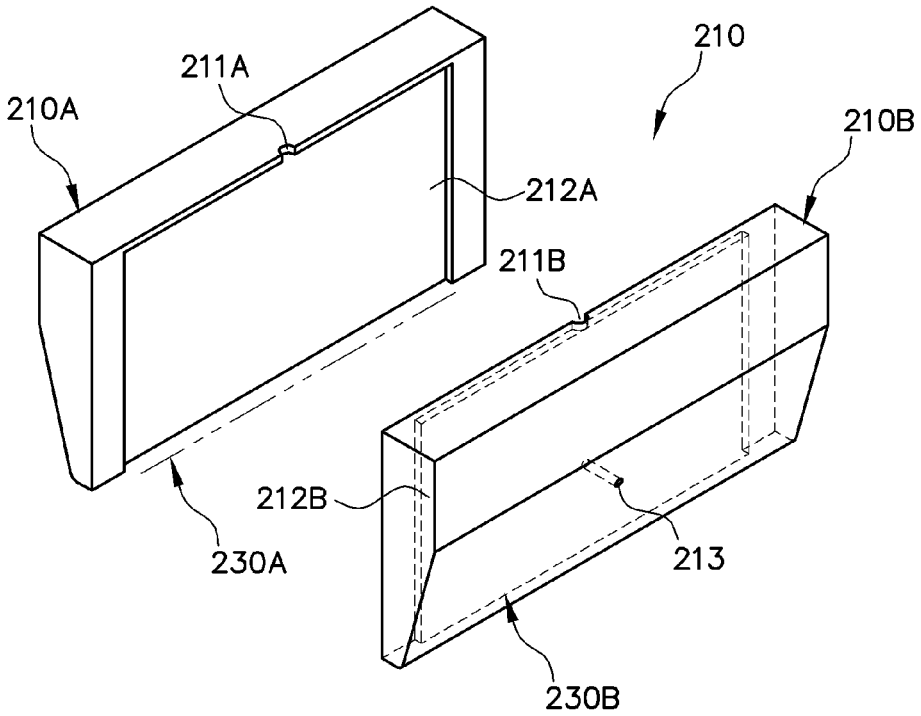

FIG. 5 is a schematic exploded perspective view a modified example of the body constituting the printing unit of the screen printing device according to the embodiment of the present invention.

For example, as illustrated in FIG. 5, a body 210 constituting a printing unit 200 may not be integrally formed, but may be implemented by coupling a plurality of separately manufactured bodies (first body 210A and second body 210B in an example of FIG. 5).

In an example, as illustrated in (a) of FIG. 5, in a state in which an ink supply hole 211 and an injection path 212 are formed in the first body 210A and one ink discharge part 230 is formed at a lower portion of the first body 201A, the first body 210A and the second body 210B may be coupled to form the body 210.

In another example, as illustrated in (b) of FIG. 5, in a state in which a first ink supply hole 211A and a first injection path 212A are formed in the first body 210A, a first ink discharge part 230A is formed at a lower portion of the first body 210A, a second ink supply hole 211B and a second injection path 212B are formed in the second body 210B, and a second ink discharge part 230B is formed at a lower portion of the second body 210B, the first body 210A and the second body 210B may be coupled to form the body 210.

Meanwhile, (a) and (b) of FIG. 5 illustrate an example in which the first body 210A and the second body 210B are coupled to form the body 210, but the number, shape, coupling type, and the like of the bodies may be freely changed by a person skilled in the art.

On the other hand, the body 210 constituting the printing unit 200 may have at least one cavity 211 configured to temporarily accommodate the ink I moving along the injection path 212.

Figure 6:
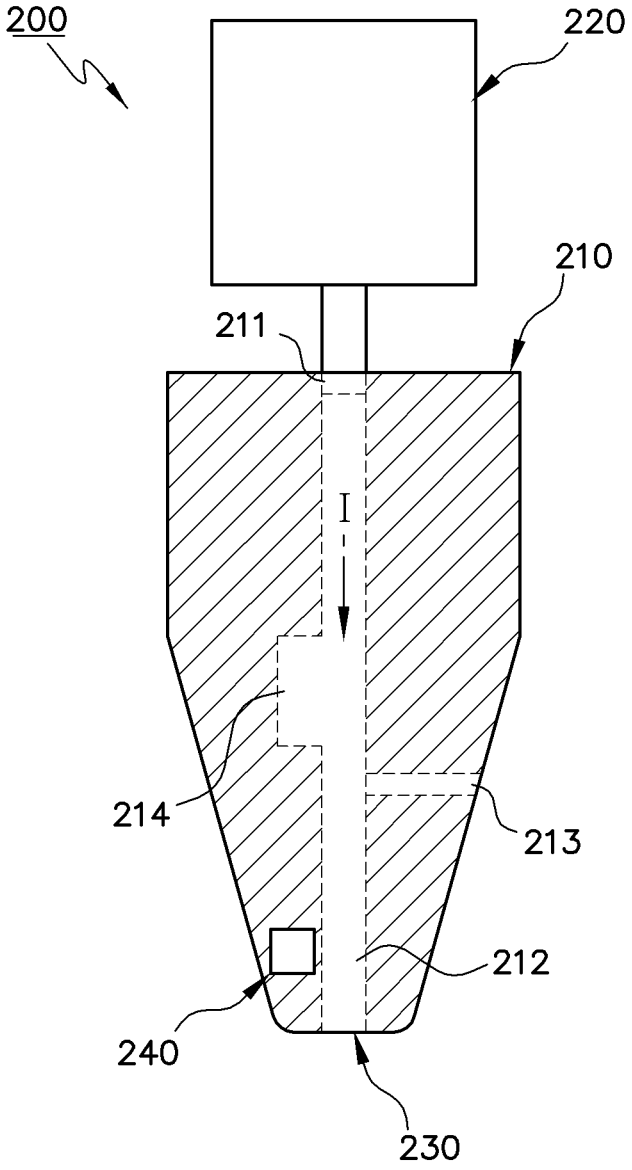
FIG. 6 is a schematic front view illustrating a state in which the body constituting the printing unit of the screen printing device according to the embodiment of the present invention further includes a cavity.

FIG. 6 is a schematic front view illustrating a state in which the body constituting the printing unit of the screen printing device according to the embodiment of the present invention further includes a cavity.

As illustrated in FIG. 6, at least one cavity 214 may be formed to communicate with the injection path 212 and may temporarily accommodate the ink I (I) moving along the injection path 212. FIG. 6 illustrates an example in which one cavity 214 having a rectangular cross section is formed, but the number, cross-sectional shape, arrangement type, and the like of the cavities 214 may be freely changed by a person skilled in the art.

As described above, in the screen printing device 1 according to the embodiment of the present invention, since the cavity 214 configured to temporarily accommodate the ink I is formed in the body 210 constituting the printing unit 200, the ink I discharged from the long ink discharge part 230 may be uniformly discharged in a width direction of the screen 100.

Meanwhile, the ink discharge part 230 constituting the printing unit 200 may be detachably attached to one side of the body 210.

Figure 7:
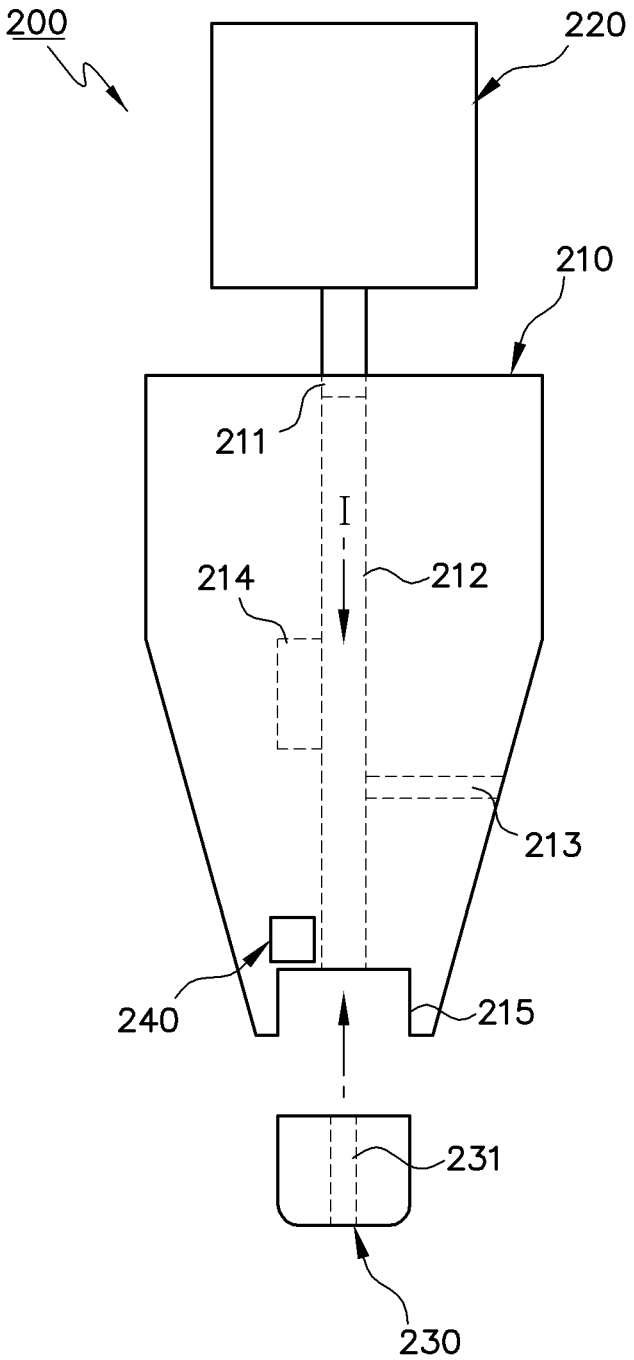
FIG. 7 is a schematic front view illustrating a state in which an ink discharge part constituting the printing unit of the screen printing device according to the embodiment of the present invention is replaceable.

FIG. 7 is a schematic front view illustrating a state in which the ink discharge part constituting the printing unit of the screen printing device according to the embodiment of the present invention is replaceable.

As illustrated in FIG. 7, the ink discharge part 230 may be detachably attached to a coupling groove 215 formed in one side of the body 210, facing the screen 100. Therefore, the ink discharge part 230 may be replaced according to printing conditions such as a kind of the ink I, a property of the ink I, and the like. As described above, it is preferable that the ink discharge part 230 is made of an elastic material so as to increase hermeticity when contacting the screen 100.

For example, assuming that a section size of an discharge port 231 formed in the ink discharge part 230 is determined according to a kind of the ink I and a property (for example, viscosity) of the ink I, even when the kind of the ink I and the property of the ink I are changed, only ink discharge part 230 connected to the body 210 may be replaced without replacing the whole of the body 210. In another example, even when a material of the ink discharge part 230 contacting the screen 100 needs to be changed according to printing conditions, only the ink discharge part 230 made of another material may be replaced.

As described above, in the screen printing device 1 according to the embodiment of the present invention, the ink discharge part 230 disposed at one side of the body 210 constituting the printing unit 200 may be detachably implemented, thereby reducing maintenance costs and simplifying maintenance operations of the screen printing device 1.

Meanwhile, the printing unit 200 constituting the screen printing device 1 according to the embodiment of the present invention may further include a temperature measurement part and temperature adjustment part, which are configured to control temperature of the ink I discharged from the ink discharge part 230.

Figure 8:
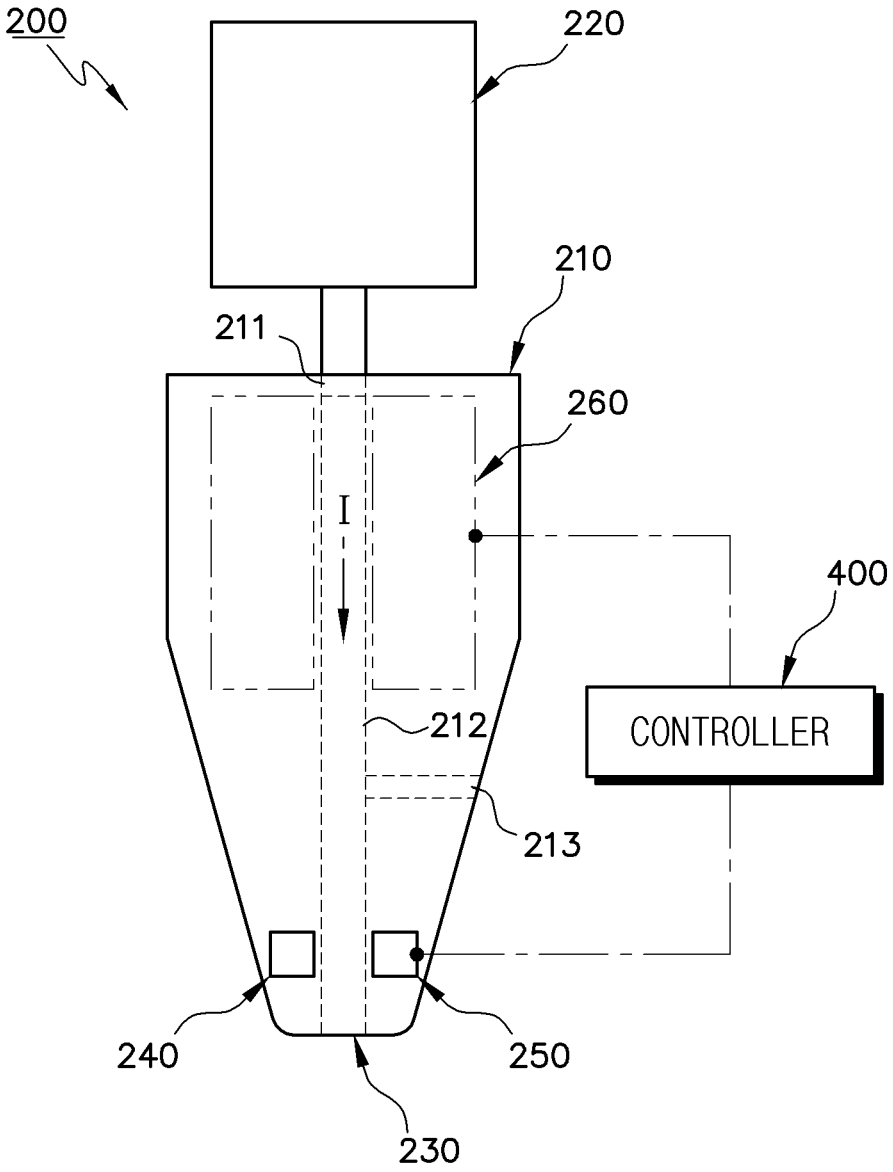
FIG. 8 is a schematic front view illustrating a state in which temperature control function is added to the printing unit constituting the screen printing device according to the embodiment.

FIG. 8 is a schematic front view illustrating a state in which temperature control function is added to the printing unit constituting the screen printing device according to the embodiment.

As illustrated in FIG. 8, a temperature measurement part 250 may be installed at a position adjacent to the ink discharge part 230 of the body 210 and may measure temperature of the ink I discharged from the ink discharge part 230. The temperature measurement part 250 may be installed at a position adjacent to the ink discharge part 230 along the ink discharge part 212 through which the ink I moves, and at least one temperature measurement part 240 may be provided as needed.

The temperature adjustment part 260 may be disposed between the ink pressurizing part 220 and the ink discharge part 230 and may adjust pressure of the ink I moving through the injection path 212. The temperature adjustment part 260 may heat or cool the ink I according to a measurement result of the temperature measurement part 250 and may adjust temperature of the ink I discharged from the ink discharge part 230.

The controller 400 may be connected to the temperature measurement part 250 and the temperature adjustment part 260 and may control the temperature measurement part 250 according to the measurement result of the temperature measurement part 250 to adjust temperature and viscosity of the ink I discharged from the ink discharge part 230. That is, in order to obtain desired temperature and viscosity, the controller 400 may control the temperature adjustment part 260 to heat or cool the ink I to appropriate temperature according to the temperature measurement result of the ink I measured by the temperature measurement part 250.

As described above, in the screen printing device 1 according to the embodiment of the present invention, temperature of the ink I discharged from the printing unit 200 may be measured, and temperature of the ink I moving along the injection path 212 may be controlled according to the measurement result to constantly maintain the temperature and viscosity of the ink I used for printing, thereby improving overall printing quality.

On the other hand, the temperature adjustment part 260 may include at least one heating member configured to increase temperature of the ink I moving along the injection path 212, and at least one cooling member configured to reduce temperature of the ink I.

Figure 9:
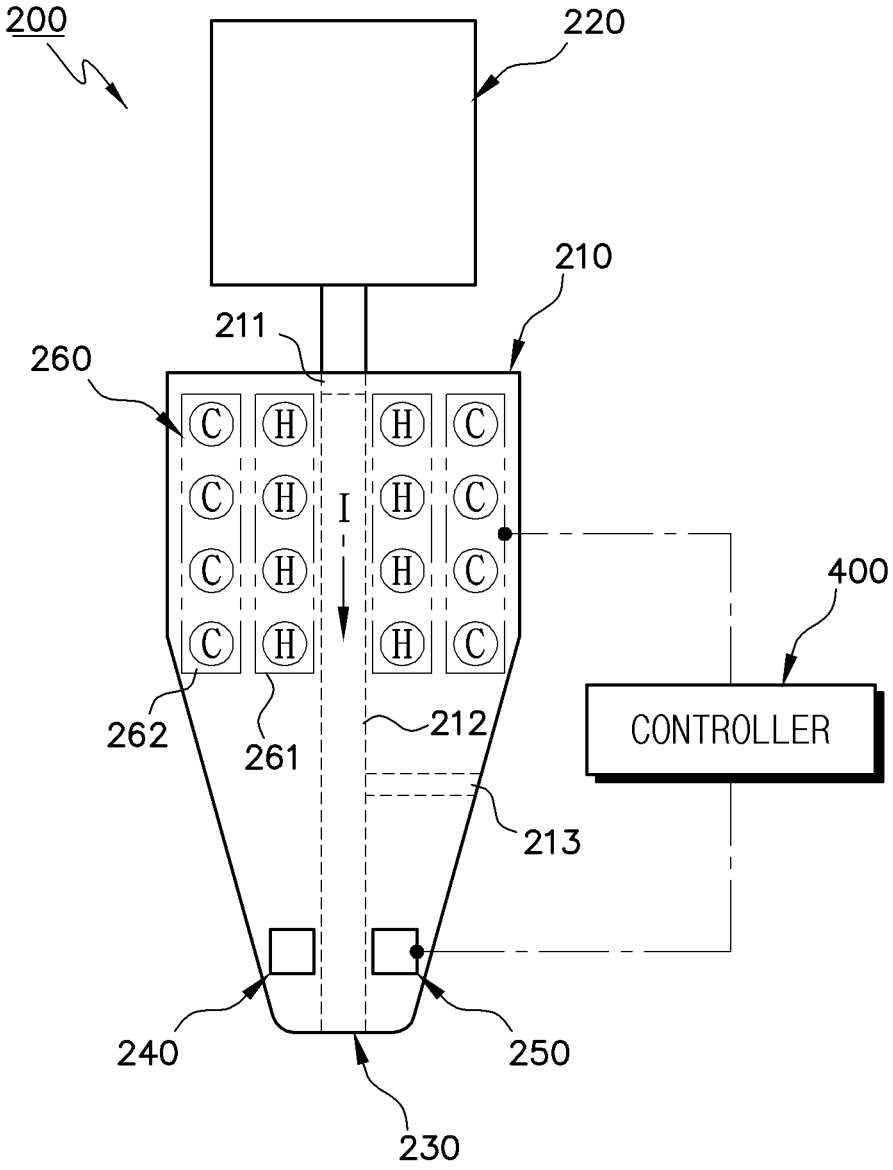
FIG. 9 is a schematic front view illustrating an example of temperature adjustment part constituting the printing unit of the screen printing device illustrated in FIG. 8.

FIG. 9 is a schematic front view illustrating an example of the temperature adjustment part constituting the printing unit of the screen printing device illustrated in FIG. 8.

As illustrated in FIG. 9, a heating member 261 may be disposed adjacent to the injection path 212 between the ink pressurizing part 220 and the ink discharge part 230, and at least one heating member 261 may be provided as needed. As illustrated in FIG. 9, a cooling member 262 may be disposed outside at least one heating member 261 between the ink pressurizing part 220 and the ink discharge part 230, and at least one cooling member 262 may be provided as needed.

For example, as a measurement result of the temperature measurement part 250, when it is necessary to increase temperature of the ink I (for example, when viscosity of the ink I is low), the controller 400 may drive both the heating member 261 and the cooling member 262 of the temperature adjustment part 260. In this case, the heating member 261 may increase temperature of the ink I moving along the injection path 212, and the cooling member 262 may block heat transferred from the heating member 261, thereby preventing hot heat from being transferred to the outside to affect the screen 100, the substrate S, and the like.

On the contrary, as a measurement result of the temperature measurement part 250, when it is necessary to decrease temperature of the ink I (for example, when viscosity of the ink I is high), the controller 400 may drive only the cooling member 262 of the temperature adjustment part 260.

As described above, in the screen printing device 1 according to the embodiment of the present invention, the heating member 261 may be disposed adjacent to the injection path 212 through which the ink I moves, and the cooling member 262 may be disposed adjacent to a surface of the body 210, thereby minimizing influence on the screen 100, the substrate S, and the like when the temperature adjustment part 260 controls the temperature of the ink I.

Although the invention has been shown and described with respect to the preferred embodiments, and specific terms have been used, the preferred embodiments and specific terms are used in their general meaning only, in order to easily describe the technical content of the present invention and to facilitate the understanding of the present invention, and are not intended to limit the scope of the present invention. It will be understood by those skilled in the art that various changes and modifications may be made without departing from the spirit and scope of the invention as defined in the following claims.

INDUSTRIAL APPLICABILITY

The present invention relates to a screen printing device. Specifically, the present invention may be applied to technical fields related to a screen printing device capable of efficiently performing a printing process on a substrate through a simpler structure and operation.

The invention claimed is:

1. A screen printing device comprising:

a screen disposed adjacent to an upper portion of a substrate on which a printing process is performed, and having a pattern to be printed on the substrate;

a printing unit disposed on an upper portion of the screen and configured to discharge ink supplied from an outside to the screen and to print the pattern on the substrate;

a driver connected to at least one of the screen and the printing unit and configured to drive at least one of the screen and the printing unit; and a controller connected to the printing unit and the driver and configured to control operations of the printing unit and the driver, wherein the printing unit comprises:

a body having an ink supply hole formed in one side thereof, through which the ink is injected, and having an injection path formed therein, through which the ink moves;

an ink pressurizing part disposed at the one side of the body so as to communicate with the injection path and configured to pressurize the ink which moves through the injection path;

an ink discharge part disposed at one side of the body, facing the screen, so as to communicate with the injection path and configured to discharge the ink in a state of being in contact with screen;

at least one pressure measurement part installed at a position adjacent to the ink discharge part of the body and configured to measure discharge pressure of the ink discharged from the ink discharge part;

a temperature measurement part installed at a position adjacent to the ink discharge part of the body and configured to measure temperature of the ink discharged from the ink discharge part; and a temperature adjustment part disposed between the ink pressurizing part and the ink discharge part and configured to adjust the temperature of the ink, wherein, when at least one of the screen and the printing device moves in a state in which the printing unit contacts the screen, the controller controls the ink pressurizing part to adjust a discharge amount and a discharge pressure of the ink according to a measurement result of the at least one pressure measurement part and controls the printing device to perform printing on the substrate by using the discharge pressure of the ink, wherein the temperature adjustment part comprises at least one heating member disposed adjacent to the injection path between the ink pressurizing part and the ink discharge part; and at least one cooling member disposed outside the at least one heating member between the ink pressurizing part and the ink discharge part, wherein the controller controls the temperature adjustment part to adjust the temperature and viscosity of the ink discharged from the ink discharge part according to a measurement result of the temperature measurement part, wherein when the temperature of the ink should be increased, the controller drives both the at least one heating member and the at least one cooling member, and when the temperature of the ink should be decreased, the controller drives the at least one cooling member.

2. The screen printing device of claim 1, wherein the body has at least one cavity formed therein, which communicates with the injection path and accommodates the ink.

3. The screen printing device of claim 1, wherein the ink discharge part is detachably installed at the one side of the body.

* * * * *